United States Patent [19]

Gageur et al.

[11] Patent Number: 4,498,250

[45] Date of Patent: Feb. 12, 1985

[54] APPARATUS FOR TREATING LENGTHS OF MATERIALS WITH A GASEOUS MEDIUM

[75] Inventors: Fritz Gageur, Lindau-Bodolz, Fed. Rep. of Germany; Horst Wohlgenannt, Bregenz, Austria

[73] Assignee: Lindauer Dornier Gesellschaft mbH, Lindau/Bodensee, Fed. Rep. of Germany

[21] Appl. No.: 550,642

[22] Filed: Nov. 10, 1983

[30] Foreign Application Priority Data

Dec. 22, 1982 [DE] Fed. Rep. of Germany ..... 3247459

[51] Int. Cl.[3] ..... F26B 13/02

[52] U.S. Cl. ..... 34/155; 15/306 A; 34/229; 68/5 D; 239/287

[58] Field of Search ..... 68/5 C, 5 E, 5 D, 6, 68/20; 15/306 R, 306 A; 34/155, 156, 222, 229; 226/97; 239/587, 588

[56] References Cited

U.S. PATENT DOCUMENTS 3,739,491 6/1973 Creapo et al. ..... 34/229 X

FOREIGN PATENT DOCUMENTS 1069111 11/1959 Fed. Rep. of Germany ..... 34/222

758911 10/1956 United Kingdom ..... 34/156

*Primary Examiner*—Philip R. Coe

*Attorney, Agent, or Firm*—W. G. Fasse; D. H. Kane, Jr.

[57] ABSTRACT

The invention relates to a treatment chamber for treating webs of material passing continuously through nozzle boxes extending pairwise above and below the material web and transversely across the width thereof. The treatment medium is fed from a conduit into one end of the nozzle boxes and their other end is closed. The nozzle boxes are not rigidly joined to the feed duct for the medium, rather they are separate from the medium feed duct and form an open end toward the feed duct. The open box ends are joined in a hinged manner to pivot levers, whereas the closed box ends are connected together by a cable running over a reversal guide roller. The spacings between the associated nozzle boxes are varied by pivoting the pivot levers in opposite directions. Furthermore, it is possible to lock the pivot levers and to fold-apart the nozzle boxes by actuating the cable.

7 Claims, 1 Drawing Figure

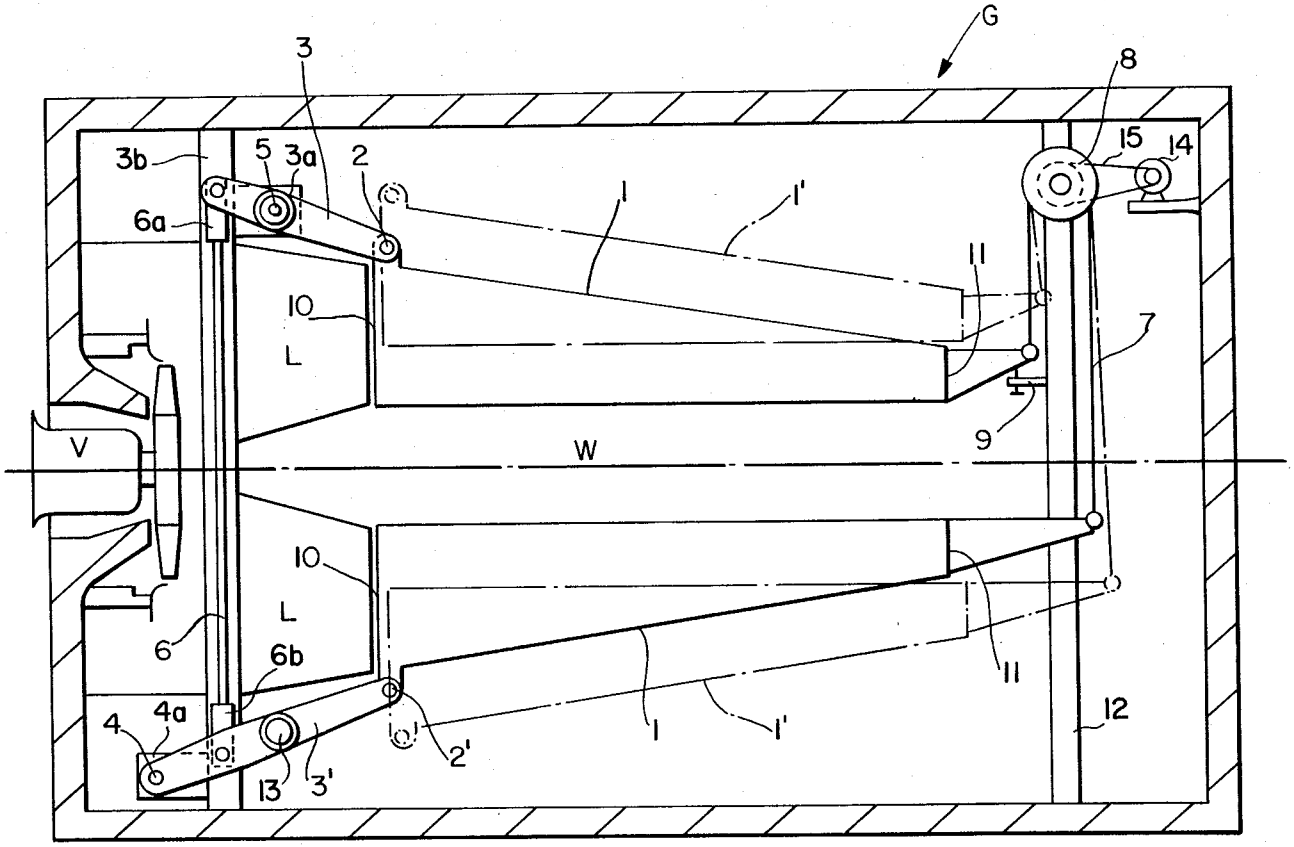
G
8
14
15
7
12
9
11
11
1'
1
1'
1
W
2
2'
3
3a
5
10
L
10
L
6b
3'
13
3b
6a
6
4a
4
V

APPARATUS FOR TREATING LENGTHS OF MATERIALS WITH A GASEOUS MEDIUM

FIELD OF THE INVENTION

This invention relates to an apparatus for treating lengths of materials with a gaseous medium in a treatment chamber. In such an apparatus the medium is blown against the material to be treated out of a row of nozzle boxes, mounted above and below the length of material and extending across the width of the material. The medium is fed to the nozzle boxes at their open end on one side of the treatment chamber. The other end of the nozzle boxes is closed.

DESCRIPTION OF THE PRIOR ART

Such apparatus is already known in various versions for the most diverse applications. It is essential when treating lengths of materials, that the flow rate of the treatment medium, for instance the air blown onto the material, or the treatment temperature at the surface of the material, is adapted to the particular circumstances to prevent excessive drying, for example. German Pat. No. 972,605 describes a chamber type apparatus operating with a gaseous treatment medium. In the treatment of textiles, the distance between the treatment apparatus and a web of material is being regulated, when there are changes in the feed through speed of the material, in an automatic and continuous manner as a function of said speed. The treatment means may be constructed to be removable or displaceable together with the associated upper and/or lower chamber sections in accordance with any particular operational requirements. Lifting and displacing means of the most diverse known constructions may be used for this purpose. To determine and limit the lifting and displacement paths and also to set the end positions, limiting means or other monitoring devices can be used. However, in addition to the stated basic concept of changing the distance, the patent does not provide a practically useful solution.

German Patent Publication No. 1,069,111 discloses another type of regulation. It describes a method and an apparatus for treating material webs with a gaseous treatment means blown in the form of jets onto the material. This prior publication is based on a state of the art wherein the treatment success when using conventional treatment means, is controlled by changing the transit speed of the material. Such a regulation, however, is no longer feasible if several treatment steps are to take place sequentially. In that case, it is no longer possible to regulate the treatment in every single treatment step by varying the transit speed of the material to be treated, unless special compensating devices are provided between the individual treatment steps. The regulation described in German Patent Publication No. 1,069,111 assumes that the speed of the material being treated will be the same in every treatment step. Therefore, this publication proposes that the treatment be regulated by controlling the effective quantity of medium blown onto the material. Several possibilities of such quantity control are described.

The apparatus described in German Patent Publication No. 1,069,111 comprises circulation devices, above and below the material to be treated. These circulation devices feed the treatment medium by means of lateral, pressurized channels to a row of nozzle boxes. The nozzle boxes are arrayed in parallel to one another and extend tranversely across the web of material. The medium is blown through slot-like nozzles in these boxes onto the material web to be treated, whereupon the medium flows from the surface of the material between two adjoining nozzle boxes back into a collecting chamber whence it passes through heat exchangers back into the circulation device. The cross-section of the discharge apertures in the nozzle boxes can be varied to regulate the rate of medium blown onto the material. Also, automatically variable control valves or flaps may be inserted into the circuit of the medium. Such control valves or flaps are provided, for instance, in the feed conduit to the pressurized channel in front of the nozzle boxes and act as throttles for the treatment medium. Further, control valves or flaps may be provided at the mentioned collecting chambers for the medium and behind the nozzle boxes, through which excess treatment medium can drain to the outside. Such control valves or flaps allow bypassing the heat exchanger in the circuit. In lieu of adjusting the discharge cross-section of the nozzles, it is possible to also vary the spacing between the nozzles or the distance of the nozzles from the web of material. The treatment systems mounted above and below the web of material and which, as explained above, comprise collecting chambers and nozzle boxes with heat exchangers and circulation devices, can be moved closer together or farther apart for varying said spacing. The upper and lower treatment systems are mounted on both sides of the material web by means of fastening devices on threaded spindles. When the threaded spindles are rotated, the fastening devices, such as nuts, are vertically displaced and thereby it is possible to adjust the spacing between the treatment systems or the distance of the treatment systems from the web of material.

However, this known apparatus has the drawback that for various reasons frequently it is impossible or inadvisable to intervene in the circulation of the treatment medium, for instance to drain excess medium. Further, the known construction with the treatment systems being vertically displaceable as a whole is complex and laborious. Any work to be done on individual nozzle boxes requires displacing the entire treatment systems. Moreover, the arrangement on threaded spindles entails the drawback that restoring a previously set spacing between the systems and especially between the nozzles following actuation of the spindles, for instance to clean the drier, can be achieved only with low accuracy.

Lastly, reference is made to German Patent Publication No. 2,245,960, which starts from the known devices described in the above cited two references. German Patent Publication No. 2,245,960 describes a transit or continuous operation drier for material webs, with drying systems provided above and below the web in a chamber. Each of the drying systems contains air feed conduits supplied by a blower and air distributors mounted transversely to the direction of advance of the material web. The vertical spacing between the two drying systems can be varied by suspending the lower drying system from the upper one and a constant spacing is maintained by adjustable stop means provided at the upper system. In this known apparatus, the upper drying system is fixed while the lower one will be lowered or raised when the spacing is changed. Because the web of material to be treated maintains its position within the drier, different spacings result above and below the length of material when the lower system is lowered or raised. These unequal spacings result in an uneven treatment of the upper and lower sides of the material web, which must be avoided.

SUMMARY OF THE INVENTION

In the light of the above prior art, it is the object of the present invention to provide a simpler apparatus to vary the spacings between the nozzle boxes or drying systems wherein it is not necessary to displace the entire drying system. Most of all, in case intervention is required regarding any irregularities in the advance of the web of material, for instance eliminating material backup, such spacing requires rapid and adequately extensive adjustment. Furthermore, the apparatus also must provide easy accessibility in order to perform work on individual nozzle boxes. The invention in this respect starts from the above discussed treatment chambers where the treatment medium is blown out of a row of nozzle boxes, mounted above and below the material web and extending transversely across the width of the web. The treatment medium is blown against the material and is fed to the nozzle boxes at one, open end thereof from one side of the treatment chamber, the other end of the nozzle boxes being closed. The foregoing objective has been achieved according to the invention by the following features:

(a) the nozzle boxes are connected at the open end thereof to pivot arms so that the nozzle boxes can move in the manner of a hinge, (b) the pivot arms of the upper and lower nozzle boxes can be synchronously pivoted in mutually opposite directions, and (c) the closed ends of the upper and lower nozzle boxes are coupled together by a cable with reversal means.

Instead of a cable, other devices similarly operating in synchronization, such as chains or belts, can be used.

In a further embodiment of the invention, the upper and lower nozzle boxes can be folded apart about the hinged connections thereof into a plane vertical to the material web. In this manner, good accessibility to the individual nozzle boxes is obtained without the necessity of displacing the entire treatment system.

BRIEF DESCRIPTION OF THE DRAWING

An illustrative embodiment of the invention is shown in the single Figure of the accompanying drawing showing a sectional view through a treatment chamber.

DETAILED DESCRIPTION OF PREFERRED EXAMPLE EMBODIMENTS AND OF THE BEST MODE OF THE INVENTION

The single Figure is a much simplified cross-sectional view of a treatment chamber. The treatment chamber comprises a housing G in which is mounted a circulation system V, shown on the left side, for a gaseous treatment medium such as air. The guide means for the treatment medium itself are not shown in any further detail. Be it noted merely that air conduits L are mounted above and below a plane W, shown in dash-dot lines, of a web of material. Being known as such, the guidance means for the web of material is not discussed further, and it also is unrelated to the concept of the invention. The only important matter is that the plane W of the web of material remains constantly at the same elevation within the housing G. The direction of advance of the web of material is perpendicular to the plane of the drawing.

Several sequentially arranged nozzle boxes 1 are connected to the upper and lower air conduits L, the row of boxes 1 extends in the direction of advance of the web of material W. These nozzle boxes 1 in the embodiment shown have an open side 10 connected to the air conduit L at their left-hand portion. Any sealing joints between the air conduit L and the nozzle boxes 1 are omitted for the sake of clarity. The nozzle boxes 1 extend transversely across the width of the web of material W and have a reduction in cross-section toward the other side or end 11, which is closed. The nozzles or slots required to discharge the medium of treatment are omitted from the drawing of the nozzle boxes 1. These nozzles are provided on that side of the nozzle boxes 1 which faces the web of material W.

As already mentioned, the nozzle boxes 1 are not rigidly joined to the air conduits L but, rather, they are connected in a hinged manner at their open ends 10 to the pivot levers 3. In the illustrative embodiment, the upper nozzle box 1 is pivoted at 2 to a two-arm pivot lever 3 supported in a spatially fixed pivot bearing 5. The pivot bearing 5 is mounted, for example, in a bearing block 3*a* located on the inside of a vertical post 3*b* mounted within the housing. The lower nozzle box 1 on the other hand is pivoted at 2' to one end of a single-arm pivot lever 3' the other end of which is pivoted at 4 to a fixed bearing block 4*a* mounted to the above-mentioned vertical post 3*b* on a side thereof opposite the bearing block 3*a*. The upper and lower pivot levers 3, 3' are mutually connected in an articulated or pivoting manner by a linkage rod 6. The linkage rod 6 may be provided at its ends with threads cooperating with threaded sleeves 6*a*, 6*b* pivotally secured to the respective lever 3, 3'. In this manner, it is possible to precisely adjust the pivot levers 3, 3' and hence the position of the nozzle boxes 1. The closed ends 11 of the nozzle boxes 1 are each connected to a cable 7 passing over a reversing roller 8. By means of this cable, the lifting of one nozzle box 1 will assure that the other associated box is lowered and vice versa. This arrangement provides a very good weight balancing, and in practice hardly any force need be exerted to displace the nozzle boxes 1. The particular associated pivot arms 3, 3' do not have to bear the entire weight of the nozzle boxes 1. In addition, the cable 7 can run passively around the reversal roller 8, but in the alternative the cable 7 can be driven where appropriate, for instance by positively driving the reversing roller 8 by a motor 14 driving a V-belt 15. Further, adjustable stop means 9 can be provided at the closed ends 11 of the nozzle boxes 1. The drawing shows, for example, one such stop means 9 mounted to a further vertical post 12 which also supports the reversing roller 8. Each nozzle box 1 will rest with its lower edge against the respective stop means 9, whereby it is possible to precisely and reproducibly set the spacings between the nozzle boxes 1 and the web of material W.

To adjust the mutual spacing between the nozzle boxes 1 of their distance to the web of material W, the lower pivot lever 3' shown in the example embodiment can be pivoted about its pivot 4, for example by a crank arm 13. When pivoting the pivot lever 3' downwardly, for instance, the boxes 1 assume the positions 1' shown in dash-dot lines. Thereby, the linkage rod 6 and the entier lower nozzle box 1 with its pivot 2' are carried along into the lower position shown in dash-dot lines 1'. The linkage rod 6 transmits the displacement of the lower pivot lever 3' to the upper pivot lever 3 causing a descending motion of the left-hand arm of the pivot lever 3 about the pivot bearing 5 and an upward move of the righ-hand arm of the pivot lever 3 thereby moving the upper nozzle box 1 and its pivot 2 into the positon shown in dash-dot lines 1'. Guide means that may be required for the open end 10 of the nozzle boxes 1 are omitted from the drawing but may be easily provided.

The described lever arrangement together with the cable 7 implements an extremely simple and rapid parallel motion, upwardly or downwardly, of the nozzle boxes 1, thereby producing a change in the spacing with respect to the web of material W or relative to the other nozzle box. Therefore, entry into the drying chamber G is possible, without cumbersome preparations, and in the shortest possible time. Because the circulation of the treatment medium is interrupted anyway for such entry, it does not matter that the nozzle boxes 1 are lifted off the air conduits L thereby producing more or less substantial gaps. The transmission ratios of the linkage rod 6 and levers 3, 3' can be so selected that full symmetry of the nozzle boxes 1 with respect to the web of material W is retained when the spacing is varied. Also, the transmission ratio allows increasing the force or pressure of the upper nozzle boxes against the holes of the upper air conduits L relative to the force or pressure of the lower nozzle boxes against the respective lower air conduits. This feature assures that the weight of the lower nozzle boxes is opposed and that these lower nozzle boxes also will be well pressed against their associated air conduits L. Furthermore, a somewhat higher weight of the upper nozzle boxes can also act in this manner.

If the lever arrangement remains at rest, the pivot levers 3, 3' are locked in place and the pivots 2, 2' act in the instantaneous position as spatially fixed bearings. If the cable 7 is then actuated, for instance by means of the reversing roller 8, the two mutually opposite upper and lower nozzle boxes 1 are folded apart about their respective pivots 2, 2' in a vertical plane transverse to the web of material W. The open ends 10 of the nozzle boxes 1 are kept at their elevations, whereas the closed ends 11 are raised or lowered. Thus, an easy accessibility to the nozzle boxes is assured. The folding-apart process just described for the nozzle boxes can take place, if required, for all the nozzle boxes of the apparatus jointly or, on the other hand, also separately for each pair of associated nozzle boxes. Further, the folding-apart can be carried out starting at any initial position of the spacing control means. As a result, substantial advantages are achieved with respect to the maintenance and repairs of the treatment chamber.

The invention is not restricted to the above-described example embodiment, rather, other embodiments of the adjustment mechanism also are possible. For instance, in a further development of the invention the linkage rod 6 may be a threaded spindle, whereby it will be possible also to adjust the pivot levers 3,3' using threaded sleeves which are displaceable in opposite directions and pivotally connected to the threaded sleeves. In that case, the lower pivot 4 may be eliminated, or it is replaced by a bearing 5 as shown for the upper pivot lever 3. Even for such an adjustment of the spacing, it will always be possible to fold apart the individual nozzle boxes about the pivots or hinge means 2, 2'. The invention may also be used when the nozzle boxes arranged sequentially in the direction of advance of the web of material W are alternatingly fed from the left or the right side, that is when the closed ends 11 of the nozzle boxes 1 are mounted alternatingly on the left and right chamber side. It will be appreciated by those skilled in the art that many modifications may be made within the scope of the present invention without departing from the spirit thereof, and the invention includes all such modifications.

What we claim is:

1. In an apparatus for treating a web of material in a treatment chamber by flowing a gaseous treatment medium onto the web through upper and lower nozzle boxes operatively arranged in said treatment chamber to form a gap through which said web may pass, each nozzle box having nozzle openings in a box wall facing said gap and a treatment medium supply inlet arranged for cooperation with a treatment medium supply conduit, the improvement comprising hinging pivot means (2, 2') connected respectively to one end (10) of each upper and lower nozzle box adjacent to said supply inlet, tilting lever means (3, 3') pivotally connected to said hinging pivot means (2, 2') of said nozzle boxes, journal means (4, 5) operatively securing said tilting lever means (3, 3') to said treatment chamber whereby said tilting lever means (3, 3') are tiltable in a plane extending substantially perpendicularly to a plane defined by said web of material, linkage drive means (6) operatively connected to said tilting lever means (3, 3') for interconnecting two nozzle boxes forming a pair for driving said tilting lever means (3, 3') in synchronism and in opposite directions, whereby said upper and lower nozzle boxes forming a pair are moved away from each other and toward each other in synchronism, so that said box walls with the nozzle openings therein extend substantially in parallel to each other in a pair of nozzle boxes, said hinging pivot means (2, 2') defining hinging axes extending in parallel to said web of material, coupling means (7) operatively connected to said upper and lower nozzle boxes forming a pair at an opposite end (11) remote from said hinging pivot means (2, 2'), and direction reversing means (8) arranged in said treatment chamber for cooperation with said coupling means (7) in such a position that said coupling means (7) may move said opposite ends (11) of said pair of nozzle boxes also in synchronism with each other and in opposite directions, whereby said upper and lower nozzle boxes forming a pair are tiltable relative to each other about said hinging axes when said tilting lever means (3, 3') are held in a stationary position, for folding apart said nozzle boxes forming a pair.

2. The apparatus of claim 1, further comprising adjustable stop means (9) operatively arranged in said treatment chamber in a position for cooperation with at least one of said nozzle boxes of a pair to limit a downward movement of said nozzle boxes.

3. The apparatus of claim 1, wherein said coupling means comprise a flexible cable (7) and wherein said direction reversing means comprise a pulley (8) over which the cable runs, said pulley (8) being located above the upper nozzle box of a pair of nozzle boxes whereby the cable forms two legs for suspending both nozzle boxes of a pair below said pulley, one cable leg becoming longer as the other cable leg becomes shorter and vice versa for lifting the respective end of one nozzle box while lowering the respective end of the other nozzle box and vice versa.

4. The apparatus of claim 3, wherein said pulley is mounted in said treatment chamber for freely rotating.

5. The apparatus of claim 3, further comprising drive means (14, 15) for separately driving said pulley.

6. The apparatus of claim 1, further comprising drive means operatively connected to said coupling means for separately driving said coupling means.

7. The apparatus of claim 1, wherein said tilting lever means comprise a single arm lever (3') for one of the nozzle boxes of a pair of nozzle boxes and a double arm lever (3) for the other nozzle box of said pair of nozzle boxes, said linkage drive means (6) pivotally connecting said one arm lever intermediate its ends to one lever arm of said double arm lever (3) the other arm of which is pivoted to the respective nozzle box for moving the nozzle boxes forming a pair in opposite directions.

* * * * *